US009893450B2

(12) United States Patent
Koyama

(10) Patent No.: US 9,893,450 B2
(45) Date of Patent: Feb. 13, 2018

(54) ELECTRICAL CONNECTING MEMBER AND ELECTRICAL CONNECTOR HAVING THE SAME

(71) Applicant: HIROSE ELECTRIC CO., LTD., Tokyo (JP)

(72) Inventor: Ryozo Koyama, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/259,254

(22) Filed: Sep. 8, 2016

(65) Prior Publication Data

US 2017/0093069 A1 Mar. 30, 2017

(30) Foreign Application Priority Data

Sep. 25, 2015 (JP) ..... 2015-188894
Jul. 1, 2016 (JP) ..... 2016-131387

(51) Int. Cl.

| | |
|---|---|
| ***H01R 13/11*** | (2006.01) |
| ***H01R 13/18*** | (2006.01) |
| ***H01R 13/187*** | (2006.01) |
| ***H01R 24/20*** | (2011.01) |
| ***H01R 101/00*** | (2006.01) |

(52) U.S. Cl.

CPC ..... *H01R 13/187* (2013.01); *H01R 13/111* (2013.01); *H01R 13/18* (2013.01); *H01R 24/20* (2013.01); *H01R 2101/00* (2013.01)

(58) Field of Classification Search

CPC .... H01R 13/187; H01R 13/15; H01R 4/4881; H01R 24/20; H01R 2101/00

USPC ..... 439/251, 827, 840, 842–845

See application file for complete search history.

(56) References Cited

U.S. PATENT DOCUMENTS 4,456,325 A * 6/1984 Benz ..... H01R 13/15 439/816
5,261,840 A * 11/1993 Benz ..... H01R 4/4881 439/843
6,186,799 B1 * 2/2001 Mello ..... H01R 4/64 238/14.14
6,547,607 B2 4/2003 Moll et al.

(Continued)

FOREIGN PATENT DOCUMENTS

JP 3566656 B2 6/2004

*Primary Examiner* — Edwin A. Leon
*Assistant Examiner* — Oscar Jimenez
(74) *Attorney, Agent, or Firm* — Kubotera & Associates, LLC

(57) ABSTRACT

An electrical connecting member includes a plurality of contact pieces for contacting with both a first conductive member and a second conductive member; and a holding member for holding the contact pieces. Each of the contact pieces includes a first contact portion for contacting with the first conductive member, a second contact portion for contacting with the second conductive member, and a held portion disposed between the first contact portion and the second contact portion and held with the holding member. The holding member includes a pair of base portions extending in parallel and a plurality of connecting portions for connecting the base portions. Each of the connecting portions includes a holding portion for holding each of the held portions of the contact pieces respectively so that the contact pieces are aligned in parallel with each other and are inclined relative to the base portions.

12 Claims, 10 Drawing Sheets

(56) References Cited

U.S. PATENT DOCUMENTS

| | | | | |
|---|---|---|---|---|
| 8,057,269 | B2 * | 11/2011 | Ledermann | H01R 13/187 439/827 |
| 2012/0129374 | A1 * | 5/2012 | Tu | H01H 1/385 439/312 |
| 2014/0038472 | A1 * | 2/2014 | Ahangar | H01R 13/05 439/825 |
| 2014/0287633 | A1 * | 9/2014 | Ahangar | H01R 13/05 439/816 |

* cited by examiner

ELECTRICAL CONNECTING MEMBER AND ELECTRICAL CONNECTOR HAVING THE SAME

BACKGROUND OF THE INVENTION AND RELATED ART STATEMENT

The present invention relates to an electrical connecting member, which electrically connect between two conductive members so that a large amount of an electrical current can flow through the conductive members. The present invention also relates to an electrical connector having such electrical connecting member(s).

Patent Reference has disclosed a conventional electrical connecting member to electrically connect between two conductive members to flow a large electrical current through the conductive members.

Patent Reference: Japanese Patent No. 3,566,656

According to Patent Reference, the conventional electrical connecting member includes electrically contact pieces, which form two flat thick plate-like conductive members, or cylindrical plugs and a cylindrical socket. Between the two conductive members, a number of electrical connecting elements is arranged, which are made of a sheet metal thinner than that of the electrical contact pieces, and the electrical connecting elements serve as the conventional electrical connecting member.

The electrical connecting element includes a plurality of electrical connecting bridges arranged and supported on a support bridge. Each of the electrical connecting bridges is formed of an inverse-V-shaped strip, which is like a triangular frame having a shape of an isosceles triangle with a base side thereof largely removed. The support band is made of a thin sheet metal. The support band includes a center web and a plurality of band portions having an arm shape. The center web extends like a strip in an arrangement direction of the plurality of electrical connecting elements. The arm-like band portions are provided at a plurality of positions, which are provided at a constant pitch in the arrangement direction, and extend both sideways from the center webs like cantilevers.

Each of the electrical connecting bridges is supported such that each of both ends of the electrical connecting bridge are clamped with corresponding ends of the band portions. As a result, the electrical connecting bridges supported by the support bands such that the electrical connecting bridges rise diagonally towards one direction relative to a sheet surface of each of the support bands.

Therefore, the electrical connecting bridge has a vertex at a center bent part of the inverse-V-shaped, which forms a contact point with one electrical connecting piece. In addition, a contact point to contact with the other electrical connecting piece is formed on both ends of a lower part of each of the electrical connecting bridge. When the electrical connecting element is disposed between the two conductive members, a number of electrical connecting bridges are pressed by the two conductive members.

Especially, the center bent part, which is the vertex of the electrical connecting bridge, receives a force from one conductive member, so that the band portion of the support band, which is located on the other conductive member, elastically displaces to twist. As a result, the electrical connecting bridge itself displaces (rotate) so as to reduce the tilting angle thereof relative to the support band. As a result, the two conductive members are electrically connected with a contact pressure to the number of electrical connecting bridges, and form a number of contact points therewith.

Therefore, it is achievable to flow a large amount of electrical current via the electrical connecting bridges between the two conductive members.

According to Patent Reference, the conventional inverse-V-shaped electrical connecting bridges are supported at their both ends with the support band, so as to be like a fixed-fixed-beam. On the other hand, the band portion of the support band, which supports the electrical connecting bridges, is like a cantilever relative to the center web, extending both sideways like branches from the center web. As a result, in a state of use, where the conventional electrical connecting bridges of the electrical connecting elements are pressed between the two contact pieces, there are problems of the center web's twisting, large heat generation, and troublesome production.

First, in a state of use, once the conventional electrical connecting bridges rotate in a direction of reducing the tilted angle to rise relative to the support bands, the clamp part at the band portion, which is a base portion of the electrical connecting bridge, causes twist on the band portion. From the center web, the band portion extends both sideways like a cantilever. Therefore, the center web receives twist from the both band portions. With this twist, the center web itself may possibly deform. The center web has a function of keeping its posture, while contacting by face with the electrical connecting piece and of keeping posture of the electrical connecting elements being held. However, with the twist of the center web, the center web cannot keep the posture.

Second, the conventional electrical connecting bridge of the electrical connecting element is formed as an inverse-V-shaped strip so as to be a fixed-fixed-beam. Therefore the sectional area of each of the electrical connecting bridges is small. Moreover, because of the shape and also in view of the relation with the clamp, the sheet thickness cannot be large so much. Therefore, even in this view, the sectional area is small. For these reasons, when large current flows in the electrical connecting bridge, it is hard to avoid large amount of heat generation.

Third, the conventional electrical connecting bridge is clamped at the both ends thereof onto the support band. Therefore, in the electrical connecting element having a number of electrical connecting bridges, the number of clamped positions increases, and the manufacturing process becomes more complicated and troublesome.

In view of the above problems, there is provided and invention, an object of which is to provide an electrical connecting member, which can keep stable posture of a plurality of electrical connecting members disposed between two conductive members, has small hear generation when large current flows therebetween, and can be easily produced. Another object of the present invention is to provide an electrically connector having the electrical connecting member.

Further objects and advantages of the present invention will be apparent from the following description of the present invention.

SUMMARY OF THE INVENTION

According to the present invention, it is achievable to solve the above-described problems with an electrical connecting member configured as follows and with an electrical connector having the electrical connecting member.

<Electrical Connecting Member>

According to a first aspect of the present invention, the electrical connecting member electrically connects between two conductive members, i.e., a first conductive member and a second conductive member. The electrical connecting member has a plurality of contact pieces and a holding member to arrange and hold the contact pieces between the two conductive members. The holding member has elasticity so as to change the holding posture of the contact pieces.

According to the first aspect of the present invention, in the electrical connecting member, the contact piece has a first contact portion, a second contact portion, and a held portion. The first contact portion is flat and, and a part of its edge contacts with the first conductive member. The second contact portion is another part of the edge and contacts with the second conductive member. The held portion is a portion to be held by the holding member between the first contact portion and the second contact portion.

According to the first aspect of the present invention, the holding member has two base portions, and connecting portions. The base portions are formed to be like strips and extend parallel to each other. The connecting portions are provided in a plurality of positions at certain intervals in a longitudinal direction of the two base portions. Each of the connecting portions has a holding portion to hold the contact piece at the held portion of the contact piece, while having sheet surfaces of adjacent contact pieces parallel in a joining direction (i.e., an extending direction) of the connecting portions, and while being tilted relative to the base portions.

According to the first aspect of the present invention, in the electrical connecting member, the contact pieces, which are flat sheet members, are held at the connecting portions of the holding member. The connecting portions extend between two base portions that are parallel to each other. Therefore, the width dimension of each of the contact pieces in the joining direction may be set so as to be close to the length of the connecting portion at the position of the held portion in a conductive members' facing direction, in which the first conductive member and the second conductive member face each other.

Furthermore, the width may be set greater than the length of the connecting portion at positions other than that of the held portion in the conductive members' facing direction. As a result, the sectional area can be large, and thereby the electrical resistance is less. Therefore, the heat generation can be small even under large current. In the state of use, when the contact pieces receive contact pressure at the first contact portions and the second contact portions from corresponding conductive members, the first conductive member and the second conductive member, the contact pieces give twisting moment to the connecting portions so as to rotate the connecting portions that hold the contact pieces. At this point, such twisting action occurs only at the connecting portions, but not at the base portions.

Furthermore, the base portions are provided at the both ends in the width direction, i.e. two base portions, and the base portions remain at their fixed positions without receiving the twisting at the connecting portions. Therefore, the base portions can keep stable posture relative to the first and the second conductive members. Moreover, since it is just needs to hold the contact pieces with the connecting portions, it is easy to manufacture the electrical connecting member.

According to a second aspect of the present invention, each of the contact pieces is formed as a flat piece, in which a first plate portion and a second plate portion are continuously formed. The first plate portion has an edge parallel to the joining direction (i.e., an extending direction of the connecting portion). On this edge, there are provided protrusions at the both ends thereof. The protrusions form the first contact portions.

According to the second aspect of the present invention, the second plate portion has slanted edges relative to the joining direction of the connecting portions. On the vertex part (common end part) of the slanted edges, there is formed a second contact portion.

According to the first aspect of the present invention, with the configuration described above, while holding the electrical connecting member by one conductive member (the first conductive member or the second conductive member), upon mounting the other conductive member (the second conductive member or the first conductive member) onto the first conductive member towards the second contact portions in the joining direction, being slidably guided with the slanted edges, the other conductive member smoothly moves and then comes to contact with the second contact portions.

According to a third aspect of the present invention, in each of the contact pieces, the second plate portion of the contact piece can have a generally triangular shape, and two sides can be formed as slanted edges. With the configuration, the second contact portion formed on the vertex part, the common end part of the two slanted edges, comes to a center position. When the second contact portions receive contact pressure from the other conductive member According to a fourth aspect of the present invention, each of the contact pieces can be formed as an isosceles triangle, such that the two slanted edges of the second plate portion of the contact piece has equal length. With this configuration, it is achievable to mount the second conductive member to the second contact portions, which are formed on the vertex parts (common end parts) of the slanted edges from either side in the joining direction.

According to a fifth aspect of the present invention, each of the contact pieces is formed as a flat piece, in which a first plate portion and a second plate portion are continuously formed. The first plate portion has an edge parallel to the joining direction. On this edge, there are provided protrusions at the both ends thereof. The protrusions form the first contact portions.

According to the fifth aspect of the present invention, the second plate portion has slanted edges and a vertex portion. The edges of the second plate portion extend from a basal part so as to be slanted relative to the joining direction of the joining member. Being continued from the edges, the vertex part is formed to extend in the joining direction. The second plate portion has slanted edges relative to the joining direction of the connecting portions. On the vertex part (common end part) of the slanted edges, there is formed a second contact portion. With this configuration, the second contact portion can have a larger area to connect to the second conductive member. As a result, it is achievable to obtain stable contact and to be compatible with large current.

According to a sixth aspect of the present invention, in each of the contact pieces, the protrusions, i.e., the first contact portions, can have an edge that extends parallel to the joining direction (i.e., the extending direction) of the joining members. With this configuration, similarly to the case of the second contact portions, the first contact portions can have larger areas to contact with the first conductive member. As a result, it is achievable to obtain stable contact and to be compatible with large current.

According to a seventh aspect of the present invention, in each of the contact piece, any of the first contact portions, slanted edges, and the second contact portions seventh aspect of preferably have some roundness in the joining direction and the sheet thickness direction. With such roundness, when the contact pieces slide to touch the first conductive member and the second conductive member, the contact pieces will not damage surfaces of the first conductive member and the second conductive member.

According to an eighth aspect of the present invention, there are preferably formed holes as carriers on the base portions at positions of the connecting portions in a longitudinal direction. When the holding members are prepared from thin sheet metal, first, the holes as carriers are formed at a part to be base portions. Then, while moving/feeding stepwise by using engaging claws that engage into the holes, the connecting portions are formed by punching out to form the windows or hole portions. The completed holding member will be cut into a suitable length for each use at a position in the longitudinal direction of the base portions. At this point, when the hole portions are provided at the positions described above, the base portions will be cut at a position between adjacent joining members. Therefore, the hole portions are not be shown at the cut sections, and it is convenient to use.

According to a ninth aspect of the present invention, the joining members can be formed to extend with a certain tilting angle relative to a longitudinal direction, in which the base portions extends, within a surface where the holding member is present. With this configuration, when the tilting angles of the holding posture of the contact pieces changes during use, since the connecting portions are made long by the tilting angles, the joining members can easily make elastic twisting displacement. Therefore, following the change of the tilting in the holding posture of the contact pieces, the joining members can easily allow the change.

<Electrical Connector>

According to a tenth aspect of the present invention, an electrical connector includes the above-described electrical connecting member, and a first conductive member to be electrically connected to the electrical connecting member. The first conductive member holds the electrical connecting member at a fixed position so as to form a unit. The unit is configured so as to be able to receive the second conductive member. With the configuration of the unit, it is achievable to integrate the second conductive member into the first conductive member so as to electrically connect to the electrical connecting member, while holding the electrical connecting member with the first conductive member so as not to come off.

According to an eleventh aspect of the present invention, the second conductive member may be integrated in the unit from the beginning.

According to a twelfth aspect of the present invention, the first conductive member may be configured so as to arrange to hold the plurality of contact pieces in a straight line and receive the second conductive member from a direction perpendicular to the arrangement direction. With the configuration, it is achievable to obtain a flat connector.

Moreover, according to a thirteenth aspect of the present invention, the first conductive member has a cylindrical outer circumferential surface or cylindrical inner circumferential surface to hold the electrical connecting member, so as to arrange to hold the plurality of contact pieces on the outer or the inner circumferential surface in the circumferential direction. In addition, the first conductive member can receive the second conductive member, which is formed as a tubular or solid cylindrical member. With this configuration, it is achievable to obtain a round electrical connector.

As described above, according to the present invention, the contact pieces to electrically connect between the two conductive members are held by the connecting portions that joint two base portions, which are formed on the holding member and are parallel to each other. Therefore, the contact pieces may be formed as flat members having large dimension but smaller than the length of the connecting portion so as to have larger sectional area. Therefore, it is achievable to restrain heat generation even under large current.

In addition, the contact pieces are held at the connecting portion of the holding member when in use, while being tilted. When the tilt is reduced, the connecting portion twists to allow the change of the tilting in the holding posture. Therefore, without causing any deformation on the base portions, it is achievable to stabilize the posture of the base portions relative to the conductive members, and in turn the posture of the electrical connecting member as a whole. Moreover, since the contact pieces just need to have the held portions be held by the connecting portions, the number of holding position can be as small as possible, and thereby the fabrication for the holding can be extremely simple.

BRIEF DESCRIPTION OF THE DRAWINGS

FIGS. 1(A) and 1(B) are views showing an electrical connecting member, a first conductive member, and a second conductive member according to a first embodiment of the present invention, wherein FIG. 1(A) is a perspective view thereof and FIG. 1(B) is a side view thereof;

FIGS. 4(A) and 4(B) are bottom perspective views showing the electrical connecting member according to the first embodiment of the present invention, wherein FIG. 4(A) is the bottom perspective view thereof before a contact piece is attached to a holding member of the electrical connecting member and FIG. 4(B) is the bottom perspective view after the contact piece is attached to the holding member of the electrical connecting member.

FIGS. 6(A) and 6(B) are bottom perspective views showing an electrical connecting member according to a second embodiment of the present invention, wherein FIG. 6(A) is the bottom perspective view thereof before a contact piece is attached to a holding member of the electrical connecting member and FIG. 6(B) is the bottom perspective view after the contact piece is attached to the holding member of the electrical connecting member;

FIGS. 7(A) and 7(B) are top perspective views showing an electrical connecting member according to a third embodiment of the present invention, wherein FIG. 7(A) is the top perspective view thereof before a contact piece is attached to a holding member of the electrical connecting member and FIG. 7(B) is the top perspective view after the contact piece is attached to the holding member of the electrical connecting member;

FIGS. 8(A) and 8(B) are perspective views showing the electrical connecting member when the contact pieces are attached to the holding member of the electrical connecting member according to the third embodiment of the present invention, wherein FIG. 8(A) is the bottom perspective view thereof and FIG. 8(B) is the top perspective view thereof;

DETAILED DESCRIPTION OF PREFERRED EMBODIMENTS

Hereunder, embodiments of the present invention will be described with reference to the accompanying drawings.

First Embodiment

Figure 1:
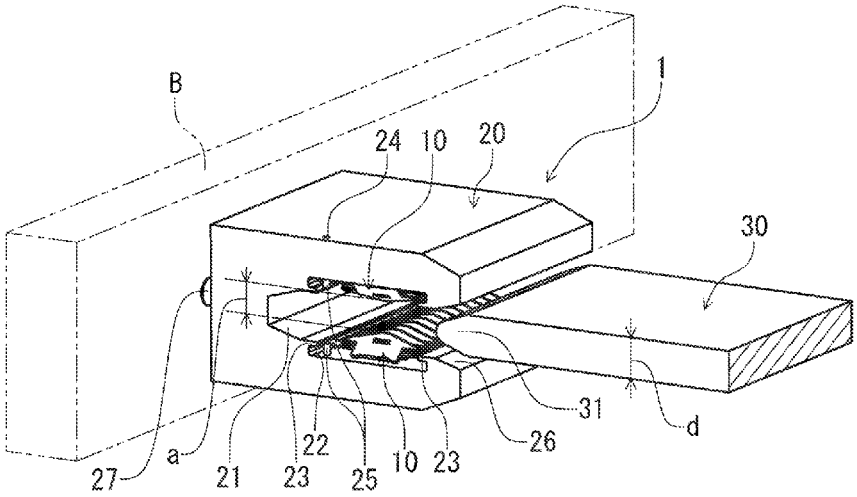
Figure 1:
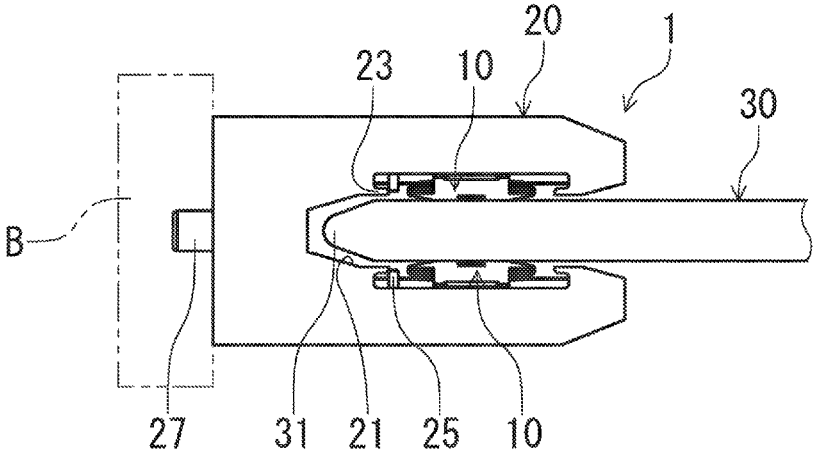

A first embodiment of the present invention will be explained. FIG. 1(A) is a perspective view of electrical connecting members according to the first embodiment of the present invention, showing the state that the electrical connecting member is about to receive a second conductive member 30 from a front side thereof in a unit 1. Here, the unit 1 is composed by mounting the electrical connecting members in a first conductive member 20. FIG. 1(B) is a side view showing the state after receiving the second conductive member 30.

As shown in FIGS. 1(A) and 1(B), the first conductive member 20 is formed as a metal block generally having a shape of a 90-degree rotated U-shape when viewed in the side views. The first conductive member 20 has a receiving groove 21, which is opened at the front side (i.e., on the right side in FIGS. 1(A) and 1(B)) and extends in a front-and-back direction, so as to be able to insert a second conductive member 30 therein from the front side (i.e., the right side in the figures). The second conductive member will be described later.

In the first embodiment, the first conductive member 20 holds the electrical connecting members 10 at an upper inner surface and a lower inner surface of the receiving groove 21, so that the electrical connecting members 10 face each other in the up-and-down direction so as not to come off therefrom. With the electrical connecting members 10 being mounted in the first conductive member 20 in this way, one unit 1 is formed. The configuration of the unit 1, i.e., the shape of the first conductive member 20 and the arrangement of the electrical connecting member 1, is symmetrical in an up-and-down direction.

In FIGS. 1(A) and 1(B), on each of the upper and lower inner surfaces of the first conductive member 20, which face each other in the up-and-down direction, there are provided holding grooves 22 that laterally extends (i.e., in a width direction of the first conductive member 20). The holding grooves 22 are for holding the electrical connecting members 10. Each of the holding grooves 22 has flange portions 23 formed on the opening side (the front side in the figure) and the bottom side (the rear side in the figure) of the receiving groove 21.

In the first embodiment, the flange portions 23 restrict both side edges of each of the electrical connecting member 10 to be engage thereto, so as to keep the electrical connecting members 10 from coming off from the holding grooves 22. In addition, on the first conductive member 20, small-diameter holes 24 are formed so as to pierce from the outer upper and lower surfaces towards the receiving groove 21. The small-diameter holes 24 are provided at position near the both side surfaces of the first conductive member 20 near ends of the flange portions 23. Into the small-diameter holes, there are engaging pins 25 hammered from the outer upper and lower surfaces.

In the first embodiment, the engaging pins 25 protrude from a bottom of the holding groove 22, and thereby can engage with the base portion of the electrical connecting members 10, which will be described later. As a result, the electrical connecting members 10 are prevented from sliding off to sideway (i.e., in the width direction of the first conductive member) from the holding groove 22. Accordingly, the electrical connecting members 10 are held in the respective upper and lower holding grooves 22 having the flange portions 23, and the unit 1 is composed.

In the first conductive member 20, inner surfaces 26 of the opening of the receiving groove 21 to receive the second conductive member 30 are slightly sloped. As a result, the groove width, which is a dimension formed (in the up-and-down direction in FIG. 1(A)) between inner surfaces of the opening of the receiving groove 21, enlarges at the front (i.e., the opened side of the receiving groove 21). Moreover, at a rear end surface of the first conductive member 20, there is provided a connecting pin 27 so as to protrude backward. The connecting pin 27 is for attaching to connect the first conductive member 20 onto a bus bar B. The bus bar B is provided on the side of a power source (not illustrated), which receives electric power from the power source.

Accordingly, the unit 1 is formed by holding the electrical connecting member 10 within the first conductive member 20, to which the bus bar B is connected. Then, to the unit 1, the second conductive member 30 is connected. According to the embodiment, the second conductive member 30 is formed as a strip-like flat member, which extends in the front-and-back direction in FIG. 1(A). The second conductive member 30 is formed as another bus bar that can be inserted to/pulled out from the receiving groove 21 of the first conductive member 20.

In the first embodiment, the second conductive member 30 has a V-shaped end 31 with the tip (rear end) having some roundness. Inserting the V-shaped end 31 of the second conductive member 30 into the receiving groove 21 of the first conductive member 20, the upper and lower electrical connecting members 10 and the top and bottom surfaces of the second conductive member 30 contact each other with certain contact pressure as shown in FIG. 1(B).

As a result the first conductive member 20 is connected to the second conductive member 30 via the electrical connecting members 10. Accordingly, the bus bar B on the power-source side receives electric power from the power source. Then, the second conductive member 30 as another bus bar on the power-distribution side receives the electric power via the unit 1 (the first conductive member 20 and the two electrical connecting members 10). From the second conductive member 30, the electric power will be distributed to specified device(s).

Figure 2:
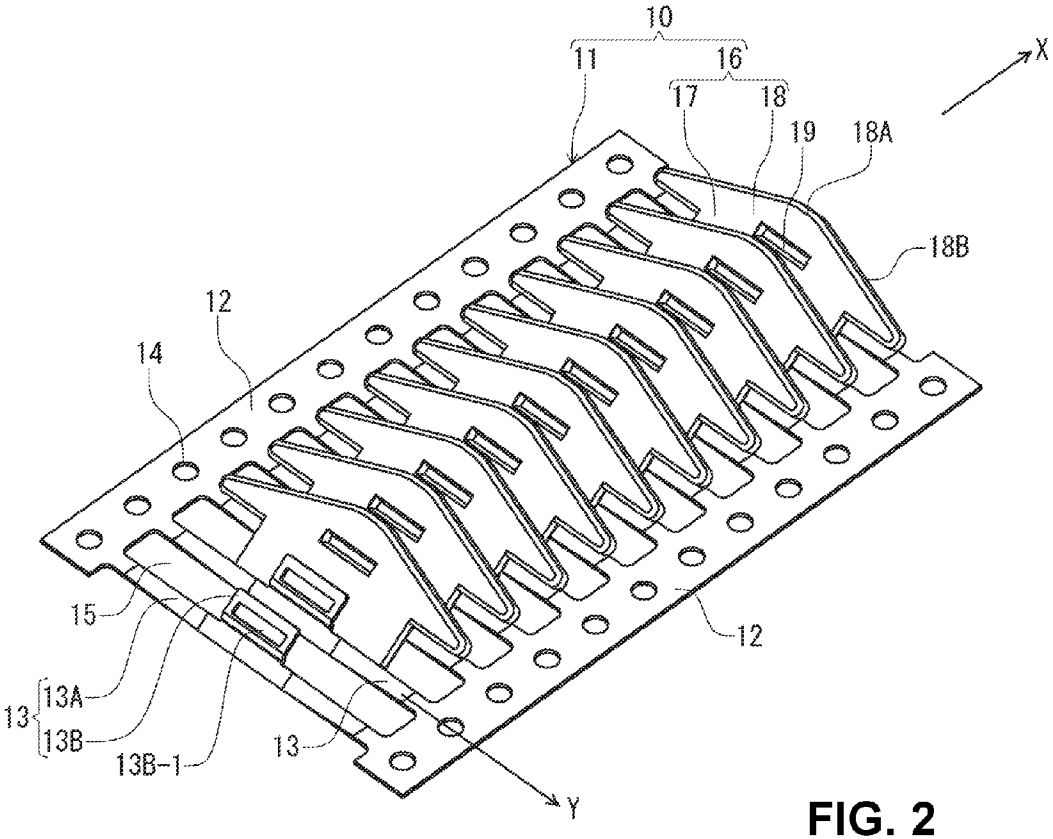
FIG. 2 is a top perspective view showing the electrical connecting member according to the first embodiment of the present invention.
Figure 3:
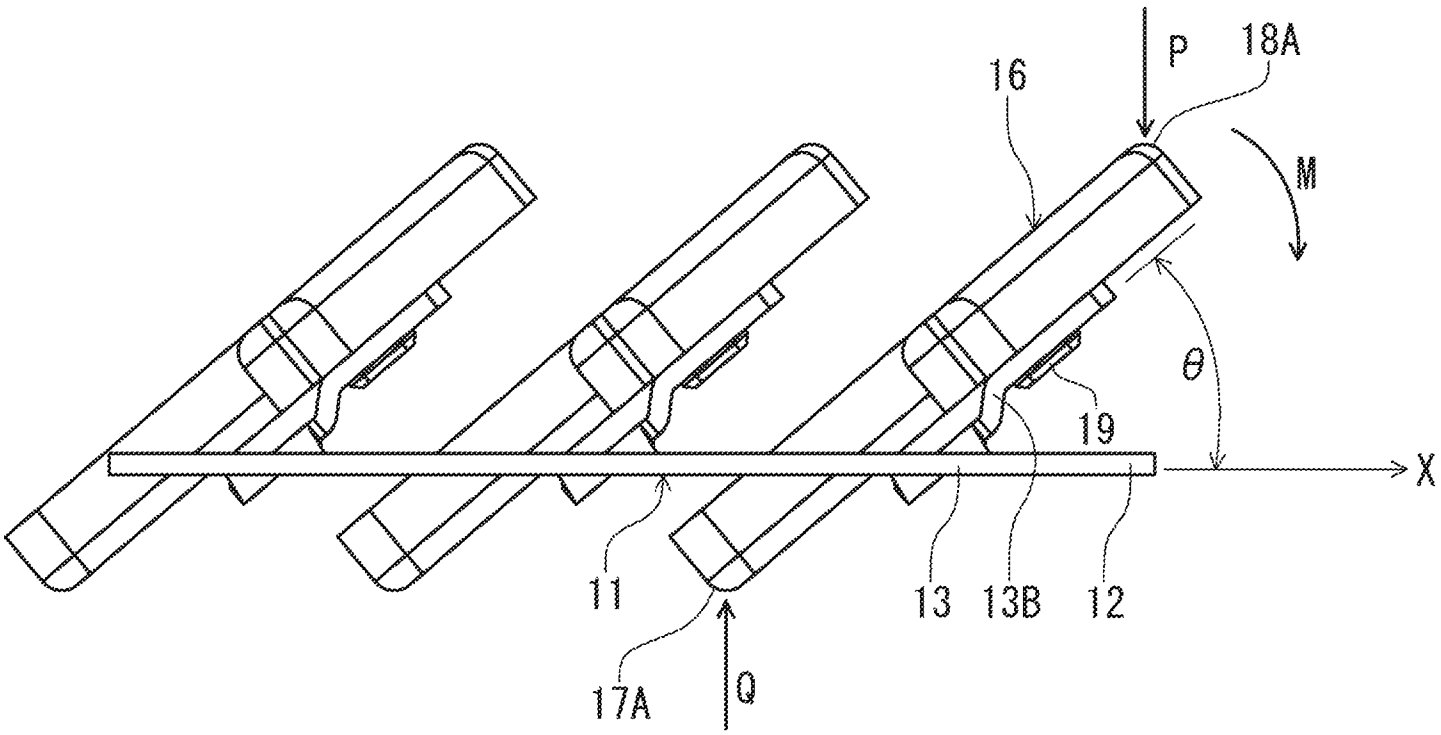
FIG. 3 is a side view showing the electrical connecting member according to the first embodiment of the present invention.

FIG. 2 is a top perspective view showing the electrical connecting member 10 according to the first embodiment of the present invention. FIG. 3 is a side view showing the electrical connecting member 10 according to the first embodiment of the present invention.

As shown in FIGS. 2 and 3, the electrical connecting members 10 are configured by arranging to hold a plurality of contact pieces 16 with the holding member 11. FIGS. 2 and 3 show a part of the electrical connecting member 10 in a longitudinal direction X, which is an arrangement direction of the contact pieces 16. FIG. 2 is a top perspective view showing the state that a part of the contact pieces 16 is removed on the left end side. FIG. 3 is the side view. Moreover, each of the electrical connecting members 10 is obtained by attaching the contact pieces 16 onto the holding member 11.

FIGS. 4(A) and 4(B) are bottom perspective views showing the electrical connecting member 10 according to the first embodiment of the present invention. More specifically, FIG. 4(A) is the bottom perspective view thereof before the contact piece 16 is attached to the holding member 11 of the electrical connecting member 10, and FIG. 4(B) is the bottom perspective view thereof after the contact piece 16 is attached to the holding member 11 of the electrical connecting member 10. The state before the attachment and the state after the attachment are shown in FIGS. 4(A) and 4(B), respectively. Here, FIGS. 4(A) and 4(B) are the view showing how to attach the connecting piece 16 onto the holding member 11. For easy understanding, FIGS. 4(A) and 4(B) are provided in upside-down views of FIGS. 2 and 3.

In the first embodiment, the holding member 11 is made by punching relatively thin metal strip-like sheet, e.g. by presswork. As shown in FIG. 2, the holding member 11 includes two base portions 12 and a plurality of connecting portions 13. The two base portions 12 extend in the longitudinal direction X of the holding member 11 and are parallel to each other. The plurality of connecting portions 13 is provided at constant intervals in the longitudinal direction X to join the two base portions 12. Here, a joining direction (i.e., a width direction of the holding member 11) Y is set as a direction that the connecting portions 13 extend.

In the first embodiment, on each of the base portions 12, there are provided holes 14 that serve as carriers. Those holes 14 are made by drilling so as to be aligned to positions of the connecting portions 13 in the longitudinal direction X. In order to fabricate the holding member 11 from strip-like sheet metal, a feeding and engaging claws (not illustrated) engage with the holes 14, so as to feed/move the strip-like sheet metal intermittently. Once the feeding/moving of the sheet metal in the longitudinal direction X stops, a thin window 15 is formed between the adjacent holes 14. Each of the windows 15 is formed so as to extend in a width direction of the strip-like sheet metal. As a result, the above-described connecting portions 13 are also formed. As described above, upon forming the connecting portions 13, the holes 14 work as carriers to feed/move the strip-like sheet metal.

In the first embodiment, each of the connecting portions 13, which joins the two base portions 12, has a strip-like portion 13A and a holding portion 13B. The strip-like portions 13A extend in the joining direction Y (i.e., the width direction of the holding member 11). Each of the holding portions 13B is provided at a middle part of one side edge of the strip-like portion 13A in the joining direction so as to be like a piece protruding therefrom. On each of the holding portions 13B, there is provided a holding window 13B-1, which is opened and is long in the joining direction (i.e., the width direction of the holding member 11).

In the first embodiment, each of the connecting portions 13 is twisted at a portion between the holding portion 13B and the base portions 12, and the holding portion 13B becomes tilted for an angle of θ relative to the base portion 12. Here, being different from the contact pieces 16, which contribute to electrical connection, the holding members 11 can be made from a stainless steel-based material or the like, which is superior in workability and inexpensive.

Next, the contact pieces 16 are formed as flat pieces from thicker sheet metal than that of the holding member 11 using copper or copper alloy, which has superior conductivity. The contact pieces 16 have high rigidity and high conductivity. In each of the contact pieces 16, an outer shape of a sheet surface thereof is a shape of a short arrow head. Each of the contact pieces 16 has a first plate portion 17 and a second plate portion 18 as a continuous one member. The first plate portion 17 forms a lower part of the contact piece 16 in FIG. 2, and has a laterally long rectangular shape. The second plate portion 18 forms an upper part relative to the first plate portion 17 and has a triangular shape.

As shown in FIGS. 4(A) and 4(B), a lower edge of the first plate portion 17 of the contact piece 16 forms a parallel edge, which extends being parallel to the connecting portions 13, with the joining direction (i.e., extending direction) Y of the connecting portions 13 being a width direction of the contact pieces 16. On the lower edge, there are provided two first contact portions 17A. Those two first contact portions 17A are formed as protrusions at positions near the both ends in the width direction.

On the other hand, the second plate portion 18 generally has a shape of isosceles triangle having two slanted edges 18B to form a bottom side protruding more in the width direction than the width of the first plate portion 17. At a vertex portion of the second plate portion 18, there is formed a second contact portion 18A. In each of the contact pieces 16, the first contact portion 17A, the second contact portion 18A, and the slanted edge 18B are formed to have some roundness in the width and sheet thickness directions of the contact piece 16.

In the first embodiment, on each of the contact piece 16, between the first contact portions 17A and the second contact portion 18A, there is provided a held portion 19. The held portion 19 is to be held by the holding portion 13B, which is formed to protrude from the connecting portion 13 of the holding member 11.

Figure 4:
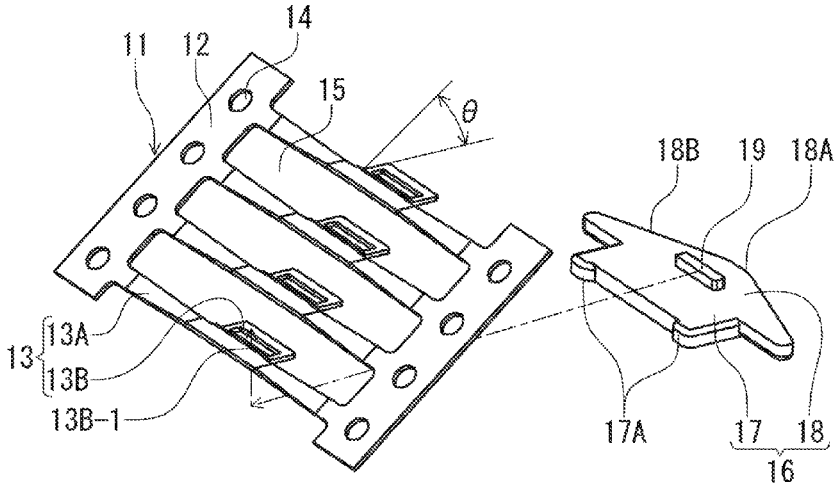
Figure 4:
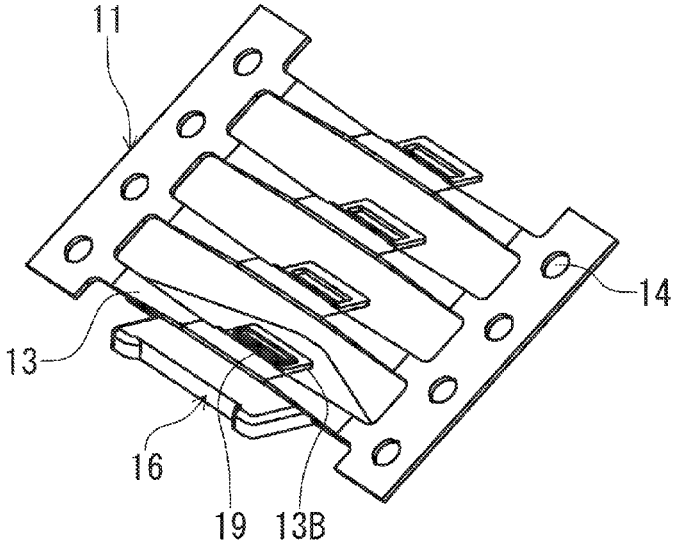

According to the first embodiment, the held portion 19 is provided at a lower part of the second plate portion 18, being close to the first plate portion 17. As shown in FIG. 4(A), the held portion 19 is formed as a laterally long protruding portion on one sheet surface (which is shown as an upper surface in the view of FIG. 4(A) and a lower surface in the view of FIG. 2) of the contact piece 16. In FIG. 4, the held portion 19 is shown as a protruding portion on the one sheet surface of the contact piece 19. In FIGS. 2 and 3, the held portion 19 is shown as a concave portion on the other sheet surface of the contact piece 16. The held portion 19 and the corresponding holding portion 13B of the holding member 11 can be provided at a plurality of positions instead of only at one position, and can be on the first plate portion 17.

In the first embodiment, when the contact pieces 16 are attached onto the holding member 11 to be held thereby as shown in FIGS. 4(A) and 4(B), the electrical connecting member 10 can be obtained.

More specifically, forming the holding member 11 that is long in the arrangement direction of the contact pieces 16, and then attaching the contact pieces onto the holding member 11, the electrical connecting member 10 may be formed. Then, the long holding member 11 can be cut into necessary length(s) to use.

Hereunder, a method of producing the electrical connecting member 10 will be described in detail.

First, prepare the holding member 11 and the contact pieces 16. In the holding member 11, the connecting portions 13 thereof are already twisted in the range of the holding portions 13B.

As shown in FIG. 4(A), bring the held portion 19 of one contact piece 16 under the holding portion 13B (i.e., the holding portion provided at the lowest position in FIG.

4(B)). Then, press the held portion 19, which is a protruding portion, into the holding window 13B-1 of the holding portion 13B, such that the held portion 19 protrudes from the holding window 13B-1. Thereafter, using a tool, swage the protruding part of the held portion so that the held portion can be securely held by the holding portion 13B (See FIG. 4(B)).

As already described above, the connecting portions 13 are twisted in the range of the holding portions 13B. Therefore, as shown in FIG. 3, the contact pieces 16 held by the holding portions 13B are held, while being tilted for the twisted angle θ from the surface of the base portions 12. In FIG. 2, the contact pieces 16 are held such that the second contact portions 18A, vertex parts of the slanted edges 18B, are directed upward relative to the holding member 11.

On the other hand, in FIG. 4(B), which is the bottom perspective view, the second contact portion 18A is directed downward relative to the holding member 11. Similarly, the rest of the contact pieces 16 is successively attached to be held onto the holding member 11 as described above and the electrical connecting member 10 can be completed. At this time, the holding member 11 is moved/fed stepwise to the holes 14, and then stopped at the holes 14 being caught by the engaging claws. The holes work as carriers.

As described above, the held portions 19 of the contact pieces 16 are attached to the holding portions 13B of the holding member 11. As a result, the contact pieces 16 are held by the holding member 11. Thereafter, the holding member 11 is to be cut at the base portions 11 to a length suitable for the first conductive member 20.

Accordingly, the plurality of the contact pieces 16 is arranged and held by the electrical connecting member 10. As shown in FIGS. 1(A) and 1(B), while orientating the electrical connecting member 10 such that the second contact portions 18A direct inward of the holding groove 22 of the first conductive member 20, the base portions 12 of the holding member 11 are inserted in place in the first conductive member from one side of the holding groove 22 (i.e., one of the side surfaces of the first conductive member 20 that face each other in the first conductive member's width direction), so as to be supported by inside of the flange portion 23.

Then, engaging pins are hammered into the small-diameter holes 24 of the first conductive member 20. Tips of the engaging pins 25 protrude towards the holding grooves 23 at positions very close to the ends of the holding member 11 (i.e., the ends of the holding member 11 in the width direction of the first conductive member 20). As a result, the electrical connecting member 10 is held by the first conductive member 20 and will not come off from any of the two sides of the first conductive member 10.

As described above, the electrical connecting member 10 is mounted in each of the holding grooves provided on the upper and lower inner surfaces of the first conductive member 20. As a result, the first contact portions 17 of the both electrical connecting members 10 face each other in the up-and-down direction. The interval "a" between the first contact portions 17A in the up-and-down direction is set smaller than a thickness "d" of the second conductive member 30.

As described above, according to the first embodiment, the unit 1 is provided in the form of an electrical connector, in which the electrical connecting members 10 having the above-described configuration are mounted in the first conductive member 20. The electrical connector having the unit 1 and the second conductive member 30 may be used as follows.

First, the connecting pins 27 provided on the rear end surface of the first conductive member 20 of the unit 1 is placed to attach in the corresponding holes (not illustrated), so as to attach the first conductive member 20 onto the bus bar B provided on the power-source side. Then, contacting the rear end surface of the first conductive member 20 to the bus bar B by surface, the first conductive member 20 and the bus bar B are electrically connected. Here, the bus bar B is electrically connected, and supplies electrical power to the first conductive member 20.

Thereafter, the second conductive member 30, which is formed as a flat strip, is mounted in the unit 1. The second conductive member 30 serves as another bus bar provided on the power-distribution side. The second conductive member 30 is inserted to between the upper and lower electrical connecting members 10, which are held in the first conductive member 20. At this point, as shown in FIG. 1(B), the second conductive member 30 pushes the both electrical connecting members 10 so as to move the second contact portions 18A of the contact pieces 16 away from each other in the up-and-down direction.

As shown in FIG. 3, since the second contact portions 18A of the contact pieces 16 receive pressing force P from the second conductive member 30, the first contact portions 17A of the contact pieces 20 receive reaction force Q from the first conductive member 20. With the pressing force P and the reaction force Q, moment M occurs on the contact pieces 16. As a result, in each of the electrical connecting member 10, the contact pieces 16 cause elastic twisting displacements of the connecting portions 13 via the holding members 13B, so as to allow decrease of the tilting angle θ in the holding posture of the contact pieces 16.

As described above, the respective contact pieces 16 of the electrical connecting members 10 electrically connect to the second conductive member 30 and the first conductive member 20, having the pressing force P and the reaction force Q as contact pressures, so as to transmit electric power. In the both electrical connecting members 10, the plurality of contact pieces 16 can independently change the tilting angle θ.

Therefore, all of the contact pieces 16 can surely contact with the second conductive member 30. Each of the contact pieces 16 has some roundness on the first contact portion 17A, the second contact portion 18A, and the slanted edges 18B in the joining direction (i.e., extending direction) of the connecting portions 13 and the sheet thickness direction thereof (i.e., the up-and-down direction in FIG. 1(A)). Therefore, when the second conductive member 30 is inserted to mount in the unit 1 and when the tilting angles θ of the contact pieces 16 change, the contact surfaces of the first conductive member 20 and the second conductive member 30 will not be damaged.

Figure 5:
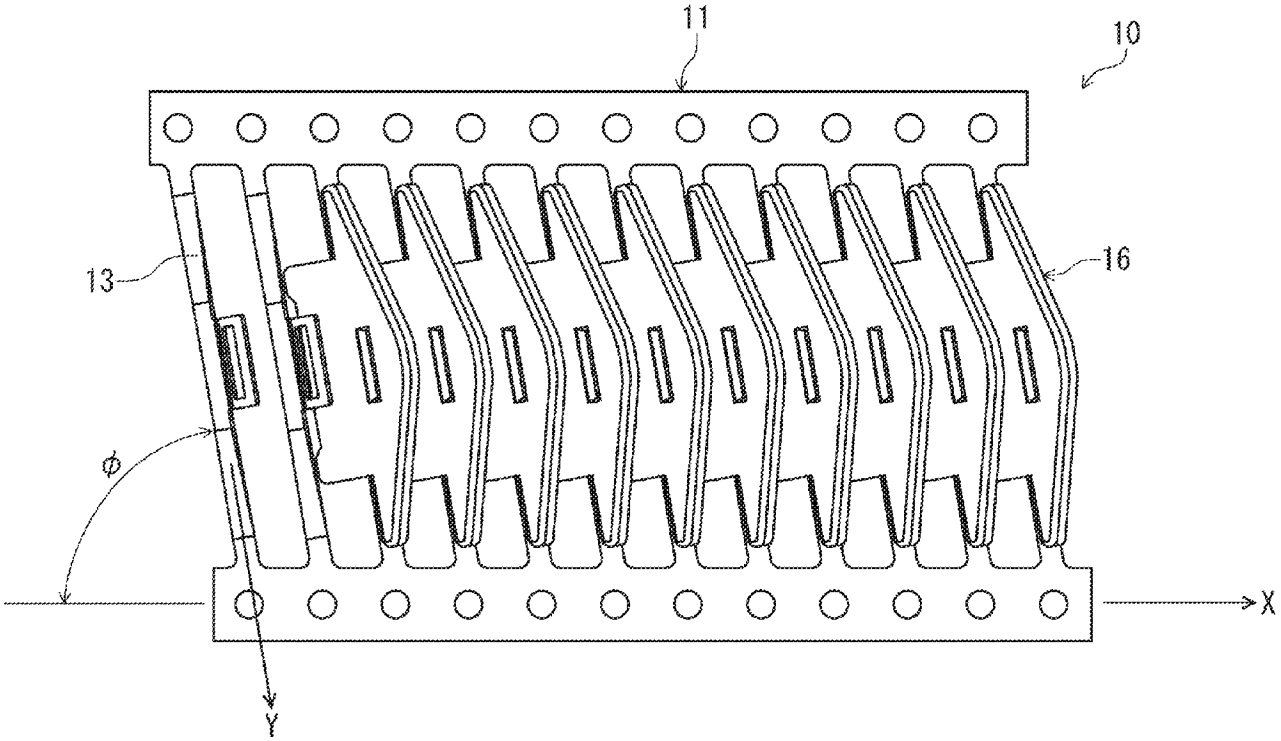
FIG. 5 is a top perspective view showing a modified example of the electrical connecting member according to the first embodiment of the present invention.

According to the first embodiment, the holding member 11 can be modified, altered, or changed. FIG. 5 is a top perspective view showing a modified example of the electrical connecting member 10 according to the first embodiment of the present invention.

As shown in FIG. 5, forming the joining direction (i.e., extending direction) Y of the joining members 13 to have an angle φ from the base portions 12, it is achievable to make the length of the joining members 13 greater than that of the interval of the two base portions 12. Furthermore, the elastic twisting displace can be easily generated, and it is achievable to securely avoid influence of the twisting on the base portions 12.

Second Embodiment

A second embodiment of the present invention will be explained next. According to the first embodiment shown in FIGS. 2 through 5, the held portions 19 are formed as laterally long protrusions (i.e., which are to be long in the extending direction of the joining member), and there are laterally long holding windows 13B-1 on the holding portions 13B, to receive the held portions 19.

Figure 6:
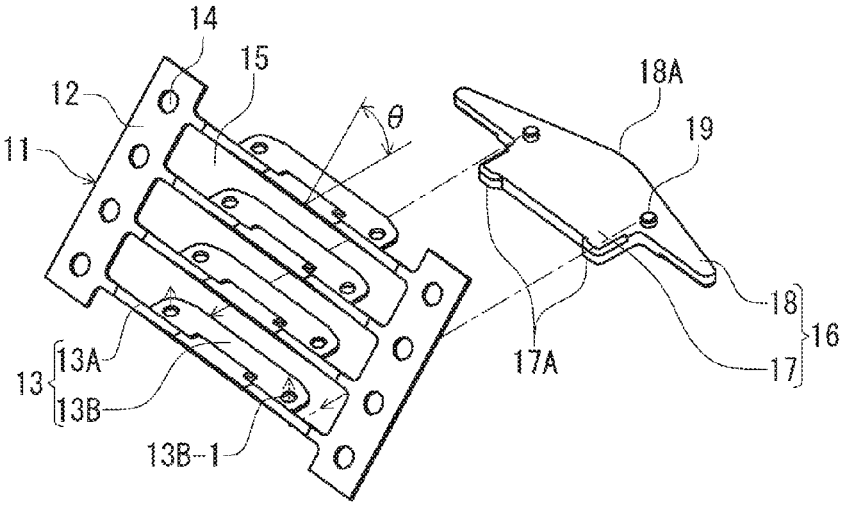
Figure 6:
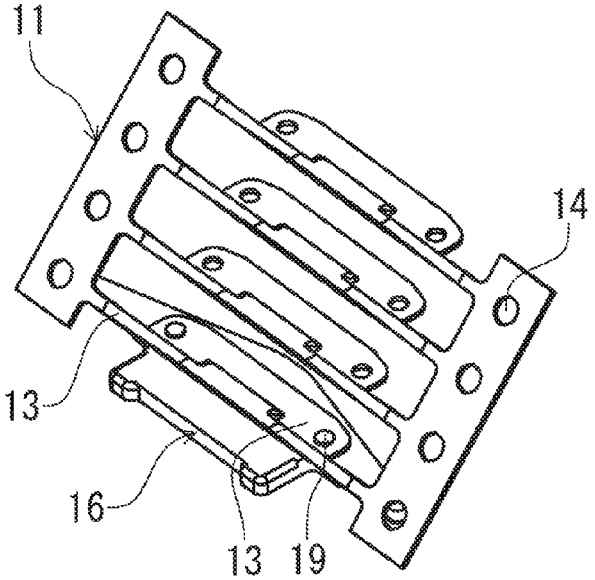

FIGS. 6(A) and 6(B) are bottom perspective views showing an electrical connecting member according to the second embodiment of the present invention. More specifically, FIG. 6(A) is the bottom perspective view thereof before the contact piece 16 is attached to the holding member 11 of the electrical connecting member and FIG. 6(B) is the bottom perspective view after the contact piece 16 is attached to the holding member 11 of the electrical connecting member.

According to the second embodiment, as shown in FIGS. 6(A) and 6(B), the held portions 19 are provided as short cylindrical protrusions provided at two positions that are away from each other in the lateral (joining) direction. Each of the holding portions 13B has holding windows that are formed as circular holes to receive the held portions 19. With this configuration, it is achievable to securely hold each of the contact pieces 16 at two positions, which are away from each other, while the held portions 19 and the holding portions 13B can have relatively simple shapes.

Third Embodiment

A third embodiment of the present invention will be explained next. According to the embodiments of FIGS. 1 through 6, in each of the contact pieces 16, the second plate portion of has a generally triangular shape. Alternatively, each of the contact pieces can have a generally a trapezoidal shape instead of the triangular shape.

Figure 7:
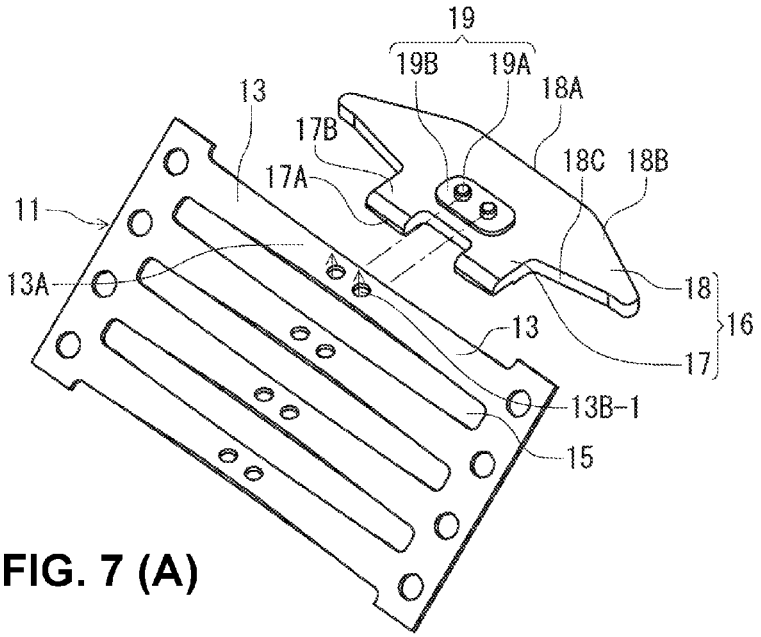
Figure 7:
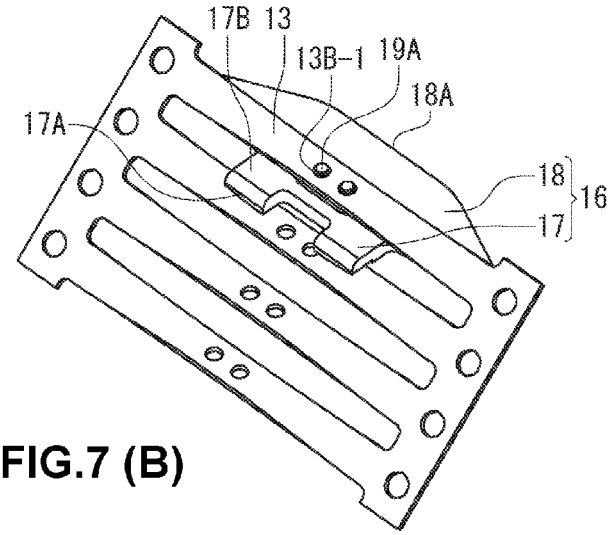

FIGS. 7(A) and 7(B) are top perspective views showing an electrical connecting member according to the third embodiment of the present invention. More specifically, FIG. 7(A) is the top perspective view thereof before the contact piece 16 is attached to the holding member 11 of the electrical connecting member and FIG. 7(B) is the top perspective view after the contact piece 16 is attached to the holding member 11 of the electrical connecting member.

According to the third embodiment, the second plate portion of the contact piece has a generally trapezoidal shape as shown in FIGS. 7(A) and 7(B). Here, in FIGS. 7(A) and 7(B), common parts with the embodiments of FIGS. 1 through 6 are referenced with the same reference numerals and explanation of those common parts is omitted.

As shown in FIG. 7(A), according to the third embodiment, in each of the contact piece 16, the second plate portion 18 has a generally trapezoidal shape. The top part of the second plate portion 18 is formed as an edge parallel to the width direction, which is to be a joining direction (i.e., the extending direction) of the connecting portion 13, and forms a second contact portion 18A. Each of the second contact portion 18A extends long in the width direction.

As a result, it is achievable to secure large contact area between the second contact portion 18A and the second conductive member 30 to flow large current. On the both ends of each of the second contact portion 18A in the width direction, a slanted edge 18B respectively extends therefrom. According to the third embodiment, in each of the contact piece 16, in addition to having the slanted edge 18B as an upper edge, lower edges 18C of the second plate portion 18 (i.e., the bottom edge parts of the trapezoidal part) are slanted downward towards the middle part of the bottom part of the trapezoidal part in the width direction of the contact piece 16, while the lower edges 18C are not slanted in the first and the second embodiments. With this configuration, it is achievable to enhance the strength at a boundary region between the second plate portion 18 and the first plate portion 17.

In the third embodiment, each of the second plate portions 18 has a held portion 19 near the first plate portion 19 in a middle part thereof in the width direction. The held portion 19 includes a washer-like portion 19B and held protrusions 19A. In each contact piece 16, the held portion 19 is formed to have the protrusions 19A by embossing so as to protrude from one sheet surface of the contact piece 16 being pressed from the other sheet surface as shown in FIG. 7(A)).

In the third embodiment, the protruding held protrusions 19A are provided in two being next to each other in the width direction of the contact piece 16. In the range that includes the two held protrusions 19A, the washer-like portion 19B is formed, extending long in the width direction and protruding from the one sheet surface of the contact piece 16. The held protrusions 19A protrude from the washer-like portion 19B.

Figure 8:
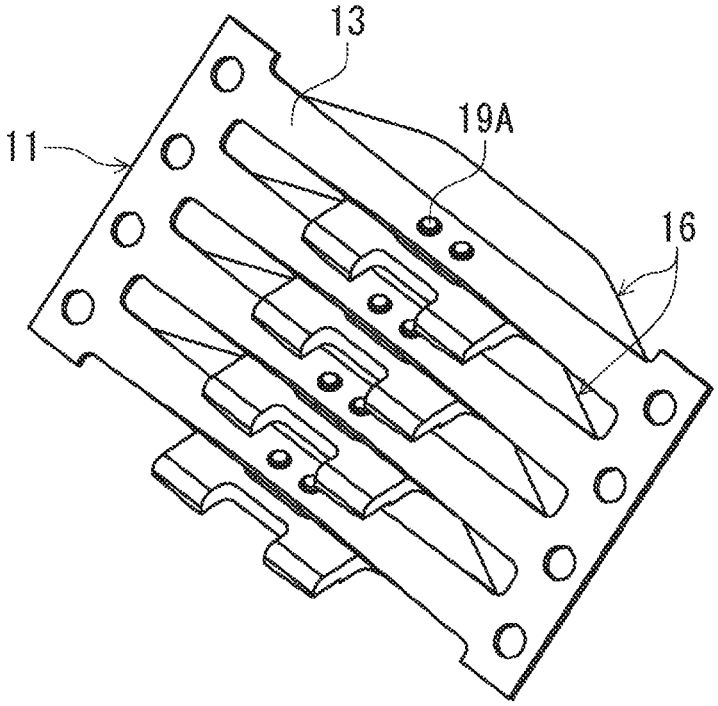
Figure 8:
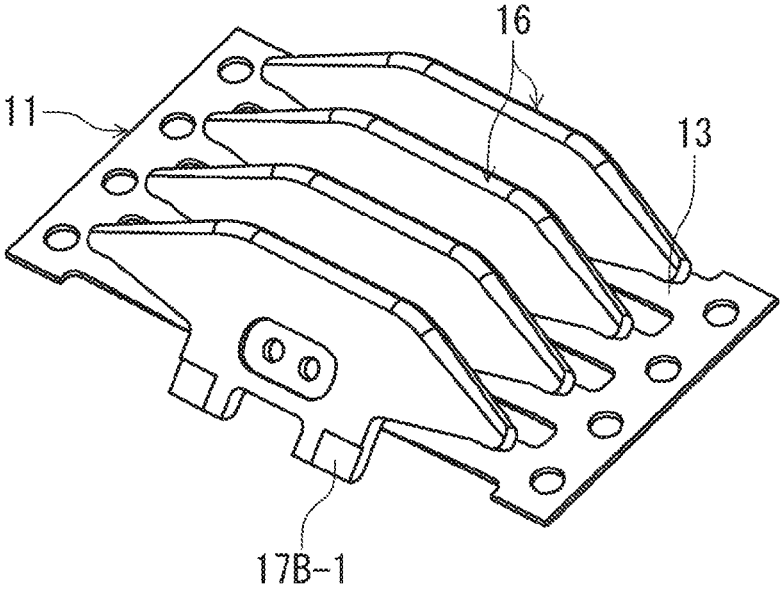

As described above, the held protrusions 19A and the washer-like portion 19B are formed by embossing to protrude from the surface of the contact piece 16 as shown FIG. 7(A). As shown in the top perspective view, FIG. 8(B), which is an upside-down view of FIG. 7(A), on the other sheet surface of the contact piece 16, a corresponding area to the held protrusions 19A and the washer-like portion 19B are dented to the side of the one sheet surface by the embossing.

In the third embodiment, the first plate portion 17 extends downward (slightly leftward in the view of FIG. 7(A)) from a lower edge of the second plate portion 18. The first plate portion 17 has two legs 17B, which are provided at a certain interval therebetween and extend downward. On the front side of the contact piece 16, which is shown in FIG. 7(A), lower ends of the legs 17B are relatively rounded being bent in the sheet thickness direction.

In the third embodiment, the lower ends are formed as first contact portions 17A, extending straight in the width direction of the contact piece 16. Since the first contact portions 17A extend long, it is achievable to secure large contact area to contact with the first conductive member 20 at the first contact portions 17A, and thereby achievable to flow large current.

As shown in FIG. 8(B), the other sheet surface (i.e., backside) of the second plate portion 18 is dented by the embossing of the holding protrusions 19A and the washer-like portion 19B. In addition, in a lower part of a backside of each leg 17B, there is formed a concave portion 17B-1 by presswork so as to reduce the thickness outside the washer-like portion in the width direction of the contact piece 16.

Once the contact pieces 16 receive pressing force from the first conductive member 20 to contact thereto, the contact pieces 16 tilt so as to reduce the angle θ (see FIG. 3) with the connecting portions 13 being fulcrums. In other words, the plurality of contact pieces 16 become close to each other. At this time, in each contact piece 16, the legs 17B having the first contact portions 17A become close to the adjacent connecting portion(s) 13 that hold other contact piece(s) 16.

In the third embodiment, on the connecting portions 13, elastic twist occurs so as to reduce the tilting angle θ. Since the elastic twist accompanies warping of the connecting portions 13, the concave portions 17B-1 formed on the backside of the legs 17B displace by the warping. The displacement is greater on the outside of the legs 17B than the inside of the legs in the width direction. The displacement of the concave portions 17B-1 contributes to avoid interference with backside of the legs 17B.

In the third embodiment, on the other hand, in the example of FIGS. 4(A) and 4(B) or FIG. 5, in each of the holding member 11 to hold the contact pieces 16, the holding windows 13B-1 are provided on the holding portions 13B on strip-like portions 13A of the connecting portions 13.

According to the third embodiment, each of the connecting portions 13 has only strip-like portion and the protruding portion is not provided. Each connecting portion 13, which forms the strip-like part, has holding windows 13B-1, which are circular holes.

According to the third embodiment, the contact pieces 16 are to be attached and held onto each of the holding members 11.

First, as shown in FIG. 7(A), insert the first plate portion 17 of each of the contact pieces 16 into one of windows 15 of the holding member 11, such that the contact piece 16 comes under the connecting portion 13.

Next, position the held protrusions 19A to fit to the holding windows 13B under the holding member 13. As described above, the held protrusions 19A are formed to protrude from each of the contact piece 16. Then, completely press the protruding held portions 19A into the holding windows 13B-1 from there (i.e., under the holding member 13). At this point, the protruding held portions 19A protrude from a surface (upper surface) of the connecting portion 13. Similarly to the case of the previously described embodiments, swage the protruding held portions 19A with a tool, so as to have the contact piece 16 be held by the connecting portion 13 (see FIG. 7(B)). The contact pieces 16 may be successively attached one by one on the holding member 11 as described above.

According to the first embodiment shown in FIGS. 4(A) and 4(B) and the second embodiment shown in FIGS. 6(A) and 6(B), each of the contact pieces 16 is attached in the order of from the lower joining member 13 to the upper joining member 13. On the other hand, according to the third embodiment, the protruding held portions 19A are provided on the contact pieces 16, being lower than those of the first and the second embodiment. Therefore, being opposite the case of the first and the second embodiment, according to the third embodiment, the contact pieces 16 are attached on the holding member 11 in the order of from the upper joining member 13 to the lower joining member 13.

FIGS. 8(A) and 8(B) show a state that the plurality of the contact pieces 16 is attached to the holding member 11 in the manner described above (FIG. 8(A) is the view showing the front surfaces of the contact pieces 16 and FIG. 8(B) is the view showing the back surfaces of the contact pieces 16).

Fourth Embodiment

Figure 9:
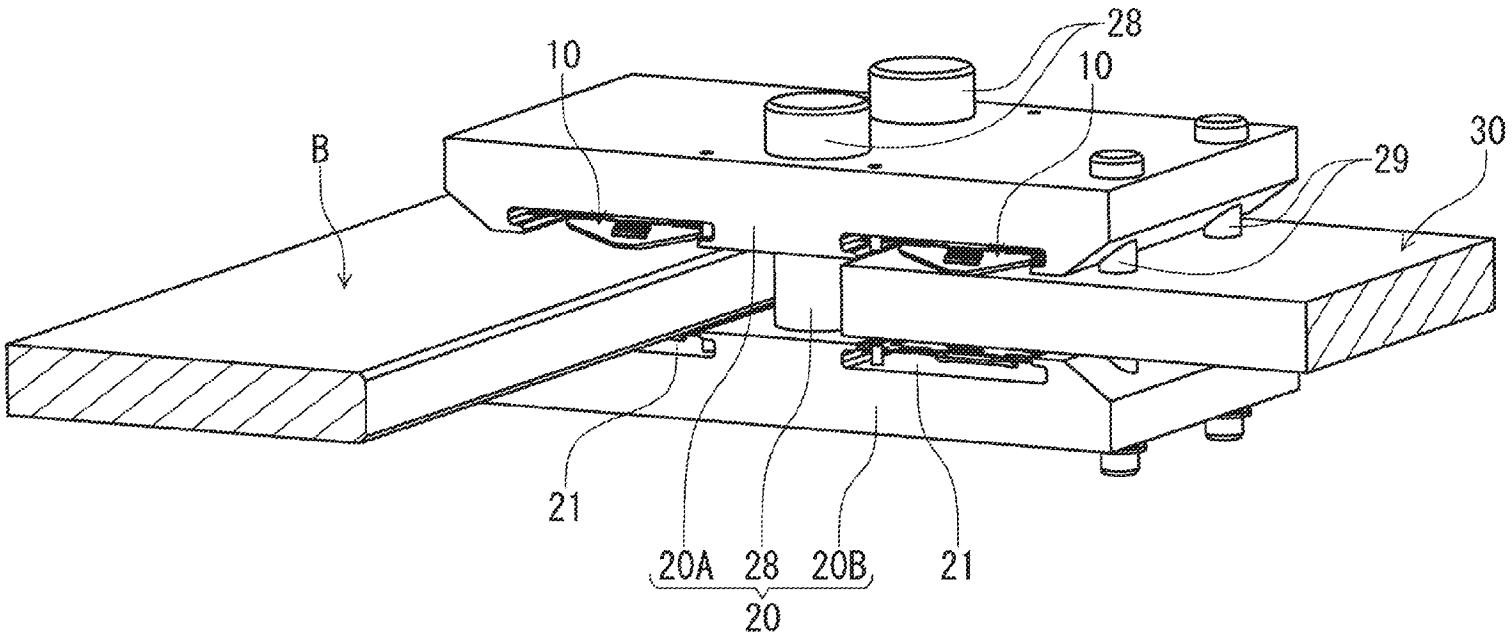
FIG. 9 is a perspective view showing a unit including the electrical connecting member according to a fourth embodiment of the present invention.

A fourth embodiment of the present invention will be explained next. FIG. 9 is a perspective view showing a unit including the electrical connecting member 10 according to the fourth embodiment of the present invention.

According to the fourth embodiment, the first conductive member 20 is formed by joining an upper and lower conductive members 20A and 20B with coupling bolts 28. The first conductive member 20 has an opening on the left and the right sides, which respectively form receiving grooves 21.

In the fourth embodiment shown in FIG. 9, the power source-side bus bar B is inserted in the left receiving groove 21. In the right receiving groove, the second conductive member 30, which serves as a power distribution-side bus bar, is inserted. In addition, the second conductive member 30 is coupled to the first conductive member 20 with the engaging pins 29 so as not to be pulled out therefrom.

According to the first through the fourth embodiments shown in FIGS. 1(A) and 1(B) through 9, a flat connector is composed of the first conductive member 20, the electrical connecting members 10, and the second conductive member 30. According to the present invention, it is also achievable to form a cylindrical connector.

Fifth Embodiment

Figure 10:
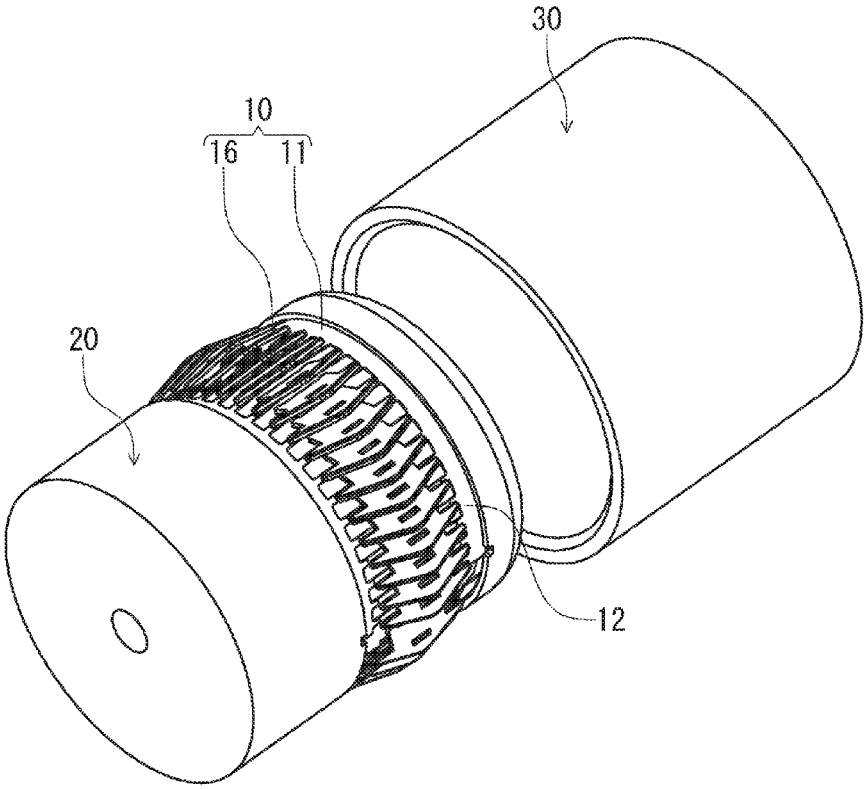
FIG. 10 is a perspective view showing the electrical connecting member, the first conductive member, and the second conductive member according to a fifth embodiment of the present invention.

A fifth embodiment of the present invention will be explained next. FIG. 10 is a perspective view showing the electrical connecting member 10, the first conductive member 20, and the second conductive member 30 according to the fifth embodiment of the present invention.

According to the fifth embodiment, the first conductive member 20 has a cylindrical shape, and the second conductive member 30 has a cylindrical shape. The electrical connecting member 10 is made by forming the holding member 13B by punching thin sheet metal. Therefore, only two thin strip-like base portions 12 continuously extend along the longitudinal direction. As a result, it is easy to flex in the sheet thickness direction to form the cylindrical shape.

According to the fifth embodiment, curving the base portions into a cylindrical shape, the electrical connecting member 10 can be accommodated by winding around into the holding grooves formed on an outer circumferential surface of the first conductive member 20. At this point, it is necessary to keep the holding member 11 not to be opened up from the wound state, by keeping the coupling ends of the base portions 12 coupled in the circumferential direction. Accordingly, the electrical connecting member 10 is wound and held around the first conductive member 20, which forms one unit 1. When the second conductive member 30 with a cylindrical shape is fitted into the unit 1, a cylindrical connector is formed.

The disclosure of Japanese Patent Applications No. 2016-131387, filed on Jul. 1, 2016, and No. 2015-188894, filed on Sep. 25, 2015, are incorporated in the application by reference.

While the present invention has been explained with reference to the specific embodiments of the present invention, the explanation is illustrative and the present invention is limited only by the appended claims.

What is claimed is:

1. An electrical connecting member to be electrically connected to a first conductive member and a second conductive member, comprising:

a plurality of contact pieces for contacting with both the first conductive member and the second conductive member; and a holding member for holding the contact pieces, wherein each of said contact pieces includes a first contact portion for contacting with the first conductive member, a second contact portion for contacting with the second conductive member, and a held portion disposed between the first contact portion and the second contact portion and held with the holding member, each of said held portions is formed of a protruding portion protruding from a plate surface of each of the contact pieces, said holding member includes a pair of base portions extending in parallel and a plurality of connecting portions for connecting the base portions, each of said connecting portions includes a holding portion for holding each of the held portions of the contact pieces respectively so that the contact pieces are aligned in parallel with each other and are inclined relative to the base portions, and each of said holding portions includes a hole portion at a center portion of each of the connecting portions so that each of the held portions is pressed into the hole portion.

2. The electrical connecting member according to claim 1, wherein each of said contact portions includes a first plate portion and a second plate portion, said first plate portion includes a first edge portion extending in parallel to the connecting portions, said second plate portion includes a pair of second edge portions inclined relative to the connecting portions, said first contact portion is formed at a protruding portion of the first edge portion, and said second contact portion is formed at an apex of the second edge portions.

3. The electrical connecting member according to claim 2, wherein said second plate portion is formed in a substantially triangle shape, and said second edge portions constitute two sides of the triangle shape inclined relative to the connecting portions.

4. The electrical connecting member according to claim 2, wherein said second plate portion is formed in a substantially isosceles triangle shape, and said second edge portions constitute two sides of the isosceles triangle shape inclined relative to the connecting portions.

5. The electrical connecting member according to claim 2, wherein said protruding portion of the first edge portion includes a fourth edge portion extending in parallel to the connection portion.

6. The electrical connecting member according to claim 2, wherein said first contact portion includes a first around portion, said second contact portion includes a second around portion, and said first edge portion includes a third around portion.

7. The electrical connecting member according to claim 1, wherein each of said contact portions includes a first plate portion and a second plate portion, said first plate portion includes a first edge portion extending in parallel to the connecting portions, said second plate portion includes a pair of second edge portions inclined relative to the connection portion and a third edge portion between the second edge portions and extending in parallel to the connecting portions, said first contact portion is formed at a protruding portion of the first edge portion, and said second contact portion is formed at the third edge portion.

8. The electrical connecting member according to claim 1, wherein each of said base portions includes a hole portion.

9. The electrical connecting member according to claim 1, wherein each of said connecting portions is inclined relative to each of the base portions.

10. An electrical connector, comprising:

said first conductive member having a receiving portion for receiving the second conductive member; and said electrical connecting member according to claim 1 retained in the first conductive member.

11. The electrical connector according to claim 10, wherein said first conductive member is configured to retain the electrical connecting member so that the contact pieces are arranged linearly in an arrangement direction, and said first conductive member is configured to receive the second conductive member in a direction perpendicular to the arrangement direction.

12. The electrical connector according to claim 10, wherein said first conductive member has at least one of a cylindrical outer circumferential surface and a cylindrical inner circumferential surface, said first conductive member is configured to retain the electrical connecting member so that the contact pieces are arranged on the at least one of the cylindrical outer circumferential surface and the cylindrical inner circumferential surface, and said first conductive member is configured to receive the second conductive member having a column shape or a cylindrical shape.

* * * * *